US010708705B2

(12) United States Patent
Suenaga et al.

(10) Patent No.: US 10,708,705 B2
(45) Date of Patent: Jul. 7, 2020

(54) AUDIO PROCESSING METHOD AND AUDIO PROCESSING APPARATUS

(71) Applicant: YAMAHA CORPORATION, Hamamatsu-shi (JP)

(72) Inventors: Tsukasa Suenaga, Iwata (JP); Futoshi Shirakihara, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/135,644

(22) Filed: Sep. 19, 2018

(65) Prior Publication Data

US 2019/0020968 A1 Jan. 17, 2019

Related U.S. Application Data

(63) Continuation of application No. PCT/JP2017/009799, filed on Mar. 10, 2017.

(30) Foreign Application Priority Data

Mar. 23, 2016 (JP) ..... 2016-058670

(51) Int. Cl.

| | |
|---|---|
| ***H04S 3/02*** | (2006.01) |
| ***H04S 7/00*** | (2006.01) |
| *H04S 1/00* | (2006.01) |

(52) U.S. Cl.

CPC ..... *H04S 7/303* (2013.01); *H04S 1/007* (2013.01); *H04S 3/02* (2013.01); *H04S 2400/01* (2013.01);

(Continued)

(58) Field of Classification Search

CPC ..... H04S 1/00; H04S 1/007; H04S 2400/11; H04S 2420/01; H04S 7/00; H04S 7/303; H04S 2400/01; H04S 3/02

(Continued)

(56) References Cited

U.S. PATENT DOCUMENTS 6,498,857 B1 * 12/2002 Sibbald ..... H04S 7/30 381/1

7,382,885 B1 6/2008 Kim et al.

(Continued)

FOREIGN PATENT DOCUMENTS

JP S59044199 A 3/1984
JP H0787599 A 3/1995

(Continued)

OTHER PUBLICATIONS

International Search Report issued in Intl. Appln. No. PCT/JP2017/009799 dated Apr. 25, 2017. English translation provided.

(Continued)

*Primary Examiner* — Vivian C Chin
*Assistant Examiner* — Friedrich Fahnert
(74) *Attorney, Agent, or Firm* — Rossi, Kimms & McDowell LLP

(57) ABSTRACT

An audio processing apparatus has a setting processor that sets a size of a virtual sound source; and a signal processor that generates an audio signal by imparting to an audio signal a plurality of head-related transfer characteristics. The plurality of head-related transfer characteristics corresponds to respective points within a range that accords with the size set by the setting processor from among a plurality of points, with each point having a different position relative to a listening point.

12 Claims, 5 Drawing Sheets

(52) U.S. Cl.
CPC ..... *H04S 2400/11* (2013.01); *H04S 2420/01* (2013.01)

(58) Field of Classification Search
USPC ..... 381/17, 18, 56, 61, 63, 89, 303, 310
See application file for complete search history.

(56) References Cited

U.S. PATENT DOCUMENTS

| | | | | |
|---|---|---|---|---|
| 9,578,440 | B2 * | 2/2017 | Otto | H04S 5/00 |
| 9,826,328 | B2 * | 11/2017 | Mehta | H04S 7/30 |
| 10,425,762 | B1 * | 9/2019 | Schissler | H04S 7/303 |
| 2002/0141597 | A1 * | 10/2002 | Wilcock | G06F 3/167 381/61 |
| 2003/0007648 | A1 * | 1/2003 | Currell | H04S 7/30 381/61 |
| 2005/0047619 | A1 | 3/2005 | Murata et al. | |
| 2007/0203598 | A1 * | 8/2007 | Seo | H04S 3/00 700/94 |
| 2010/0080396 | A1 * | 4/2010 | Aoyagi | H04S 1/005 381/17 |
| 2015/0189457 | A1 * | 7/2015 | Donaldson | H04S 7/303 381/1 |
| 2016/0157010 | A1 * | 6/2016 | Oellers | H04R 1/02 381/89 |
| 2019/0020968 | A1 * | 1/2019 | Suenaga | H04S 7/303 |

FOREIGN PATENT DOCUMENTS

| | | | |
|---|---|---|---|
| JP | 2001028800 | A | 1/2001 |
| JP | 2005157278 | A | 6/2005 |
| JP | 2013201564 | A | 10/2013 |

OTHER PUBLICATIONS

Written Opinion issued in Intl. Appln. No. PCT/JP2017/009799 dated Apr. 25, 2017.
Extended European Search Report issued in European Appln. No. 17769984.0 dated Sep. 20, 2019.
Schissler "Efficient HRTF-based Spatial Audio for Area and Volumetric Sources" IEEE Transactions on Visualization and Computer Graphics. Apr. 2016. vol. 22, No. 4, pp. 1356-1366.
Office Action issued in Japanese Appln. No. 2016-058670 dated Feb. 12, 2020. English translation provided.
Office Action issued in Chinese Appln. No. 201780017507.X dated Feb. 3, 2020. English translation provided.

* cited by examiner

AUDIO PROCESSING METHOD AND AUDIO PROCESSING APPARATUS

CROSS REFERENCE TO RELATED APPLICATIONS

This application is a Continuation Application of PCT Application No. PCT/JP2017/009799, filed Mar. 10, 2017, and is based on and claims priority from Japanese Patent Application No. 2016-058670, filed Mar. 23, 2016, the entire contents of each of which are incorporated herein by reference.

BACKGROUND OF THE INVENTION

Field of the Invention

The present invention relates to a technique for processing an audio signal that represents a music sound, a voice sound, or other type of sound.

Description of Related Art

Reproducing an audio signal with head-related transfer functions convolved therein enables a listener to perceive a localized virtual sound source (i.e., a sound image). For example, Japanese Patent Application Laid-Open Publication No. S59-44199 (hereafter, Patent Document 1) discloses imparting to an audio signal a head-related transfer characteristic from a sound source at a single point to an ear position of a listener located at a listening point, where the sound source is situated around the listening point.

The technique disclosed in Patent Document 1 has a drawback in that, since a head-related transfer characteristic corresponding to a single-point sound source around a listening point is imparted to an audio signal, a listener is not able to perceive a spatial spread of a sound image.

SUMMARY OF THE INVENTION

In view of the foregoing, an object of the present invention is to enable a listener to perceive a spatial spread of a virtual sound source.

In order to solve the problem described above, an audio processing method according to a first aspect of the present invention sets a size of a virtual sound source; and generates a second audio signal by imparting to a first audio signal a plurality of head-related transfer characteristics. The plurality of head-related transfer characteristics corresponds to respective points within a range that accords with the set size from among a plurality of points, with each point having a different position relative to a listening point.

An audio processing apparatus according to a second aspect of the present invention includes at least one processor configured to execute stored instructions to: set a size of a virtual sound source; and generate a second audio signal by imparting to a first audio signal a plurality of head-related transfer characteristics, the plurality of head-related transfer characteristics corresponding to respective points within a range that accords with the set size from among a plurality of points, with each point having a different position relative to a listening point.

DESCRIPTION OF THE EMBODIMENTS

Figure 1:
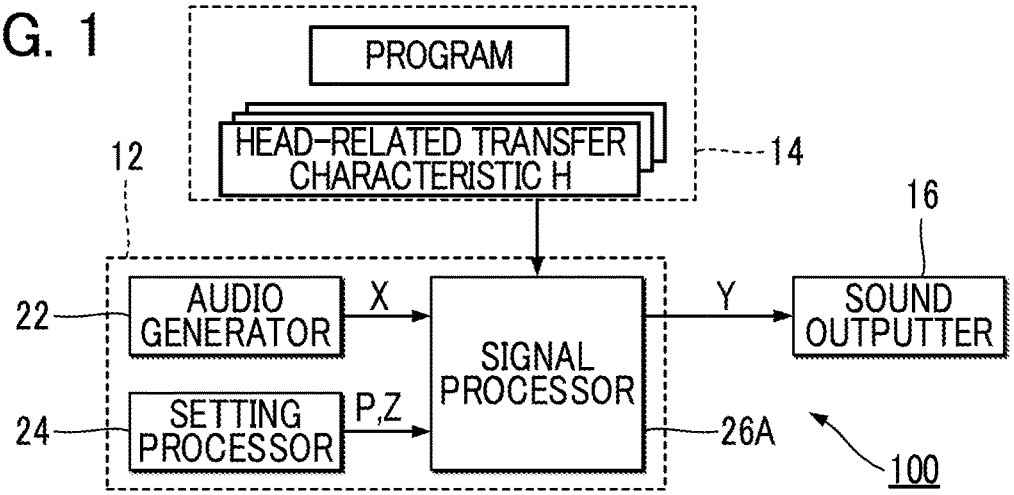
FIG. 1 is a block diagram showing an audio processing apparatus according to a first embodiment of the present invention.

FIG. 1 is a block diagram showing an audio processing apparatus 100 according to a first embodiment of the present invention. As shown in FIG. 1, the audio processing apparatus 100 according to the first embodiment is realized by a computer system having a control device 12, a storage device 14, and a sound outputter 16. For example, the audio processing apparatus 100 may be realized by a portable information processing terminal, such as a portable telephone, a smartphone; a portable game device; or a portable or stationary information-processing device, such as a personal computer.

The control device 12 is, for example, processing circuitry, such as a CPU (Central Processing Unit) and integrally controls each element of the audio processing apparatus 100. The control device 12 of the first embodiment generates an audio signal Y (an example of a second audio signal) representative of different types of audio, such as music sound or voice sound. The audio signal Y is a stereo signal including an audio signal YR corresponding to a right channel, and an audio signal YL corresponding to a left channel. The storage device 14 has stored therein programs executed by the control device 12 and various data used by the control device 12. A freely-selected form of well-known storage media, such as a semiconductor storage medium and a magnetic storage medium, or a combination of various types of storage media may be employed as the storage device 14.

The sound outputter 16 is, for example, audio equipment (e.g., stereo headphones or stereo earphones) mounted to the ears of a listener. The sound outputter 16 outputs into the ears of the listener a sound in accordance with the audio signal Y generated by the control device 12. A user listening to a playback sound output from the sound outputter 16 perceives a localized virtual sound source. For the sake of convenience, a D/A converter, which converts the audio signal Y generated by the control device 12 from digital to analog, has been omitted from the drawings.

As shown in FIG. 1, the control device 12 executes a program stored in the storage device 14, thereby to realize multiple functions (an audio generator 22, a setting processor 24, and a signal processor 26A) for generating the audio signal Y. A configuration in which the functions of the control device 12 are dividedly allocated to a plurality of devices, or a configuration in which part or all of the functions of the control device 12 is realized by dedicated electronic circuitry, is also applicable.

The audio generator 22 generates an audio signal X (an example of a first audio signal) representative of various sounds produced by a virtual sound source (sound image). The audio signal X of the first embodiment is a monaural time-series signal. For example, a configuration is assumed in which the audio processing apparatus 100 is applied to a video game. In this configuration, the audio generator 22 dynamically generates, in conjunction with the progress of the video game, an audio signal X representative of a sound, such as a voice sound uttered by a character such as a monster existing in a virtual space, along with sound effects produced by a structure (e.g., a factory) or by a natural object (e.g., a water fall or an ocean) existing in a virtual space. A signal supply device (not shown) connected to the audio processing apparatus 100 may instead generate the audio signal X. The signal supply device may be, for example, a playback device that reads the audio signal X from any one of various types of recording media or a communication device that receives the audio signal X from another device via a communication network.

The setting processor 24 sets conditions for a virtual sound source. The setting processor 24 of the first embodiment sets a position P and a size Z of a virtual sound source. The position P is, for example, a virtual sound source position relative to a listening point within a virtual space, and is specified by coordinate values of a three-axis orthogonal coordinate system within a virtual space. The size Z is the size of a virtual sound source within a virtual space. The setting processor 24 dynamically specifies the position P and the size Z of the virtual sound source in conjunction with the generation of the audio signal X by the audio generator 22.

The signal processor 26A generates an audio signal Y from the audio signal X generated by the audio generator 22. The signal processor 26A of the first embodiment executes signal processing (hereafter, "sound image localization processing") using the position P and the size Z of the virtual sound source set by the setting processor 24. Specifically, the signal processor 26A generates the audio signal Y by applying the sound image localization processing to the audio signal X such that the virtual sound source having the size Z (i.e., two-dimensional or three-dimensional sound image) that produces the sound of the audio signal X is localized at the position P relative to the listener.

Figure 2:
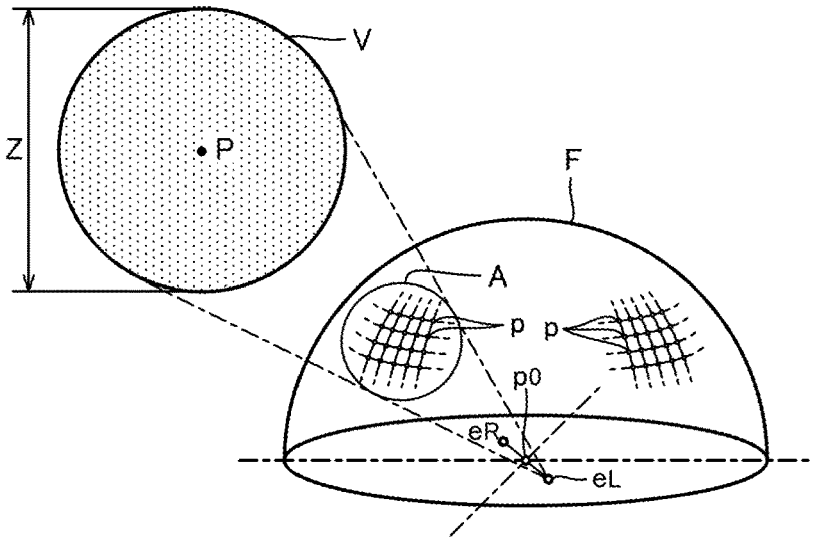
FIG. 2 is an explanatory diagram illustrating head-related transfer characteristics and a virtual sound source.

As shown in FIG. 1, the storage device 14 of the first embodiment has stored therein a plurality of head-related transfer characteristics H to be used for the sound image localization processing. FIG. 2 is a diagram explaining the head-related transfer characteristics H. As shown in FIG. 2, for each of multiple points p on a curved surface F (hereafter, "reference plane") situated circumferentially around a listening point p0, a right-ear head-related transfer characteristic H and a left-ear head-related transfer characteristic H are stored in the storage device 14. The reference plane F is, for example, a hemispherical face centered around the listening point p0. Azimuth and elevation relative to the listening point p0 define a single point p on the reference plane F. As shown in FIG. 2, a virtual sound source V is set in a space on an outer side of the reference plane F (the side opposite the listening point p0).

The right-ear head-related transfer characteristic H corresponding to an arbitrary point p on the reference plane F is a transfer characteristic of the sound produced at a point source positioned at the point p being transferred therefrom to reach an ear position eR in the right ear of the listener located at the listening point p0. Similarly, the left-ear head-related transfer characteristic H corresponding to an arbitrary point p on the reference plane F is a transfer characteristic of the sound produced at a point source positioned at the point p being transferred therefrom to reach an ear position eL in the left ear of the listener located at the listening point p0. The ear position eR and the ear position eL refer to a point at an ear hole each of an ear of the listener located at the listening point p0. The head-related transfer characteristic H of the first embodiment is expressed in the form of a head-related impulse response (HRIR), which is in the time-domain. In other words, the head-related transfer characteristic H is expressed by time-series data of samples representing a waveform of head-related impulse responses.

Figure 3:
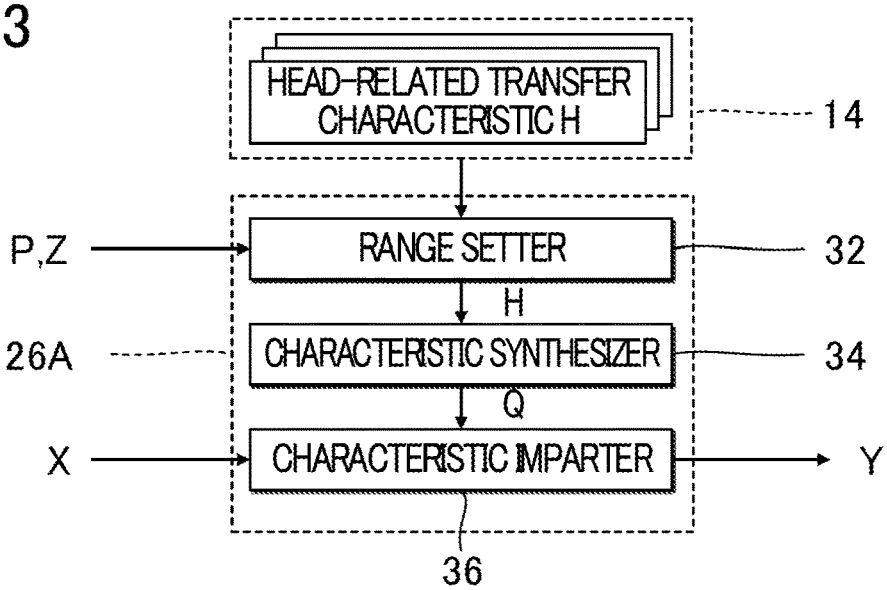
FIG. 3 is a block diagram of a signal processor.

FIG. 3 is a block diagram showing a configuration of the signal processor 26A of the first embodiment. As shown in FIG. 3, the signal processor 26A of the first embodiment includes a range setter 32, a characteristic synthesizer 34, and a characteristic imparter 36. The range setter 32 sets a target range A corresponding to the virtual sound source V. As shown in FIG. 2, the target range A in the first embodiment is a range that varies depending on the position P and the size Z of the virtual sound source V set by the setting processor 24.

The characteristic synthesizer 34 in FIG. 3 generates a head-related transfer characteristic Q (hereafter, "synthesized transfer characteristic") that reflects N (N being a natural number equal to or greater than 2) head-related transfer characteristics H by synthesis thereof. The N head-related transfer characteristics H correspond to various points p within the target range A set by the range setter 32, from among a plurality of head-related transfer characteristics H stored in the storage device 14. The characteristic imparter 36 imparts the synthesized transfer characteristic Q generated by the characteristic synthesizer 34 to the audio signal X, thereby to generate the audio signal Y. In other words, the audio signal Y reflecting the N head-related transfer characteristics H according to the position P and the size Z of the virtual sound source V is generated.

Figure 4:
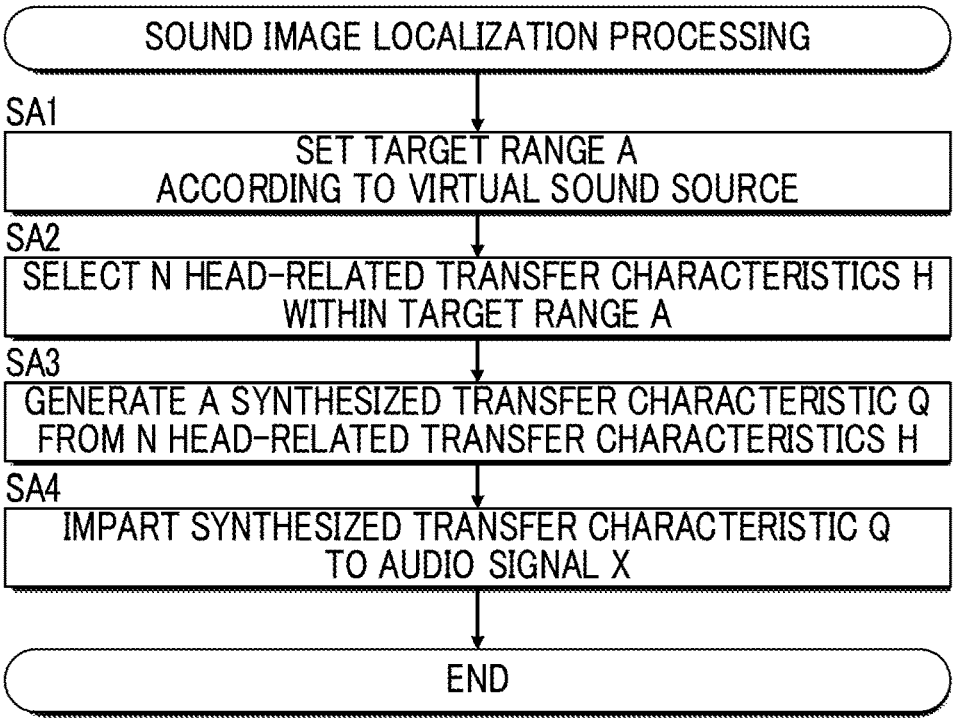
FIG. 4 is a flowchart illustrating a sound image localization processing.

FIG. 4 is a flowchart illustrating a sound image localization processing executed by the signal processor 26A (the range setter 32, the characteristic synthesizer 34, and the characteristic imparter 36). The sound image localization processing in FIG. 4 is triggered, for example, when the audio signal X is supplied by the audio generator 22 and the virtual sound source V is set by the setting processor 24. The sound image localization processing is executed in parallel or sequentially for the right ear (right channel) and the left ear (left channel) of the listener.

Upon start of the sound image localization processing, the range setter 32 sets the target range A (SA1). As shown in FIG. 2, the target range A is a range that is defined on the reference plane F and varies depending on the position P and the size Z of the virtual sound source V set by the setting processor 24. The range setter 32 according to the first embodiment defines the target range A as a range of the projection of the virtual sound source V onto the reference plane F. A relation of the ear position eR relative to the virtual sound source V differs from that of the ear position eL, and therefore, the target range A is set individually for the right ear and the left ear.

Figure 5:
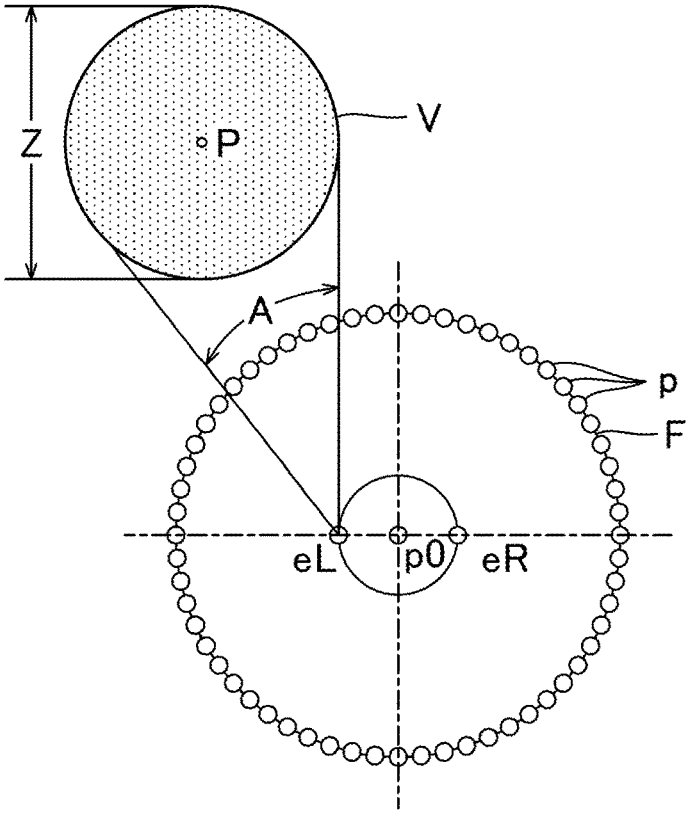
FIG. 5 is an explanatory diagram illustrating a relation between a target range and a virtual sound source.

FIG. 5 is a diagram explaining a relation between the target range A and the virtual sound source V. FIG. 5 shows a two-dimensional state of a virtual space when viewed from the upper side in a vertical direction, for the sake of convenience. As shown in FIG. 2 and FIG. 5, the range setter 32 of the first embodiment defines the target range A for the left ear as a range of the perspective projection of the virtual sound source V onto the reference plane F, with the ear position eL of the left ear of the listener located at the listening point p0 being the projection center. In other words, the target range A of the left ear is defined as a closed region, namely a region enclosed by the locus of points of intersections between the reference plane F and straight lines each of which passes the ear position eL and is tangent to the surface of the virtual sound source V. In the same manner, the range setter 32 defines the target range A for the right ear as a range of the perspective projection of the virtual sound source V onto the reference plane F, with the ear position eR of the right ear of the listener being the projection center. Accordingly, the position and the area of the target range A vary depending on the position P and the size Z of the virtual sound source V. For example, if the position P of the virtual sound source V is unchanged, the larger the size Z of the virtual sound source V, the larger the area of the target range A. If the size Z of the virtual sound source V is unchanged, the farther the position P of the virtual sound source V is from the listening point p0, the smaller is the area of the target range A. The number N of the points p within the target range A varies depending on the position P and the size Z of the virtual sound source V.

After setting the target range A in accordance with the above procedure, the range setter 32 selects N head-related transfer characteristics H that correspond to different points p within the target range A, from among a plurality of head-related transfer characteristics H stored in the storage device 14 (SA2). Specifically, N right-ear head-related transfer characteristics H corresponding to points p within the target range A for the right ear and N left-ear head-related transfer characteristics H corresponding to points p within the target range A for the left ear are selected. As described above, the target range A varies depending on the position P and the size Z of the virtual sound source V. Therefore, the number N of head-related transfer characteristics H selected by the range setter 32 varies depending on the position P and the size Z of the virtual sound source V. For example, the larger the size Z of the virtual sound source V (i.e., when the area of the target range A is larger), the greater the number N of head-related transfer characteristics H selected by the range setter 32. The farther the position P of the virtual sound source V is from the listening point p0 (i.e., when the area of the target range A is smaller), the less is the number N of head-related transfer characteristics H selected by the range setter 32. Since the target range A is set individually for the right ear and the left ear, the number N of head-related transfer characteristics H may differ between the right ear and the left ear.

The characteristic synthesizer 34 synthesizes the N head-related transfer characteristics H selected from the target range A by the range setter 32, thereby to generate a synthesized transfer characteristic Q (SA3). Specifically, the characteristic synthesizer 34 synthesizes the N head-related transfer characteristics H for the right ear to generate a synthesized transfer characteristic Q for the right ear, and synthesizes the N head-related transfer characteristics H for the left ear to generate a synthesized transfer characteristic Q for the left ear. The characteristic synthesizer 34 according to the first embodiment generates a synthesized transfer characteristic Q by obtaining a weighted average of the N head-related transfer characteristics H. Accordingly, the synthesized transfer characteristic Q is expressed in the form of the head-related impulse response, which is in the time domain, similarly to that for the head-related transfer characteristics H.

Figure 6:
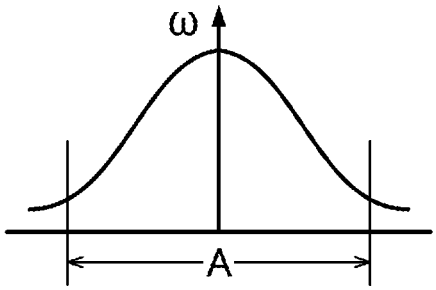
FIG. 6 is an explanatory diagram illustrating a relation between a target range and weighted values of head-related transfer characteristics.

FIG. 6 is a diagram explaining weighted values ω used for the weight averaging of the N head-related transfer characteristics H. As shown in FIG. 6, a weighted value ω for the head-related transfer characteristic H at a point p is set according to the position of the point p within the target range A. Specifically, the weighted value ω has the greatest value at a point p that is close to the center of the target range A (e.g., the center of the figure). The closer a point p is to the periphery of the target range A, the smaller is the weighted value ω. Accordingly, the generated synthesized transfer characteristic Q will predominantly reflect the head-related transfer characteristics H of points p close to the center of the target range A, and the influence of the head-related transfer characteristics H of points p close to the periphery of the target range A will be relatively small. The weighted value ω distribution within the target range A can be expressed by various functions (e.g., a distribution function such as normal distribution, a periodic function such as a Sine curve, or a window function such as hanning windows).

The characteristic imparter 36 imparts to the audio signal X the synthesized transfer characteristic Q generated by the characteristic synthesizer 34, thereby generating the audio signal Y (SA4). Specifically, the characteristic imparter 36 generates an audio signal YR for the right channel by convolving in the time domain the synthesized transfer characteristic Q for the right ear into the audio signal X; and generates an audio signal YL for the left channel by convolving in the time domain the synthesized transfer characteristic Q for the left ear into the audio signal X. As will be understood from the foregoing, the signal processor 26A of the first embodiment functions as an element that generates an audio signal Y by imparting to an audio signal X a plurality of head-related transfer characteristics H corresponding to various points p within a target range A. The audio signal Y generated by the signal processor 26A is supplied to the sound outputter 16, and the resultant playback sound is output into each of the ears of the listener.

As described in the foregoing, in the first embodiment, N head-related transfer characteristics H corresponding to respective points p are imparted to an audio signal X, thereby enabling the listener of the playback sound of an audio signal Y to perceive a localized virtual sound source V as it spreads spatially. In the first embodiment, N head-related transfer characteristics H within a target range A, which varies depending on a size Z of a virtual sound source V, are imparted to an audio signal X. As a result, the listener is able to perceive various sizes of a virtual sound source V.

In the first embodiment, a synthesized transfer characteristic Q is generated by weight averaging N head-related transfer characteristics H by assigning thereto weighted values ω, each of which is set depending on a position of each point p within a target range A. Consequently, it is possible to impart to an audio signal X a synthesized transfer characteristic Q having diverse characteristics, with the synthesized transfer characteristic Q reflecting each of multiple head-related transfer characteristics H to an extent depending on a position of a corresponding point p within the target range A.

In the first embodiment, a range of the perspective projection of a virtual sound source V onto a reference plane F, with the ear position (eR or eL) corresponding to a listening point p0 being the projection center, is set to be a target range A. Accordingly, the area of the target range A (and also the number N of head-related transfer characteristics H within the target range A) varies depending on a distance between the listening point p0 and the virtual sound source V. As a result, the listener is able to perceive the change in distance between the listening point and the virtual sound source V.

Second Embodiment

A second embodiment according to the present invention will now be described. In each of configurations described below, elements having substantially the same actions or functions as those in the first embodiment will be denoted by the same reference symbols as those used in the description of the first embodiment, and detailed description thereof will be omitted as appropriate.

Figure 7:
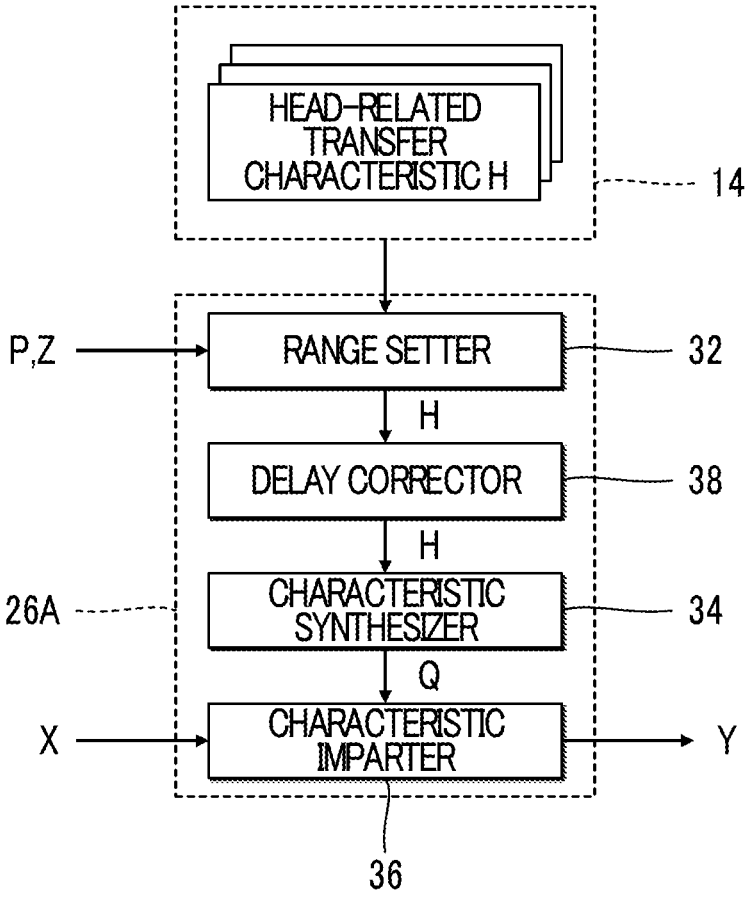
FIG. 7 is a block diagram showing a signal processor according to a second embodiment.

FIG. 7 is a block diagram of a signal processor 26A in an audio processing apparatus 100 according to the second embodiment. As shown in FIG. 7, the signal processor 26A according to the second embodiment has a configuration in which a delay corrector 38 is added to the elements of the signal processor 26A according to the first embodiment (the range setter 32, the characteristic synthesizer 34, and the characteristic imparter 36). Similarly to in the first embodiment, the range setter 32 sets a target range A that varies depending on a position P and a size Z of a virtual sound source V.

Figure 8:
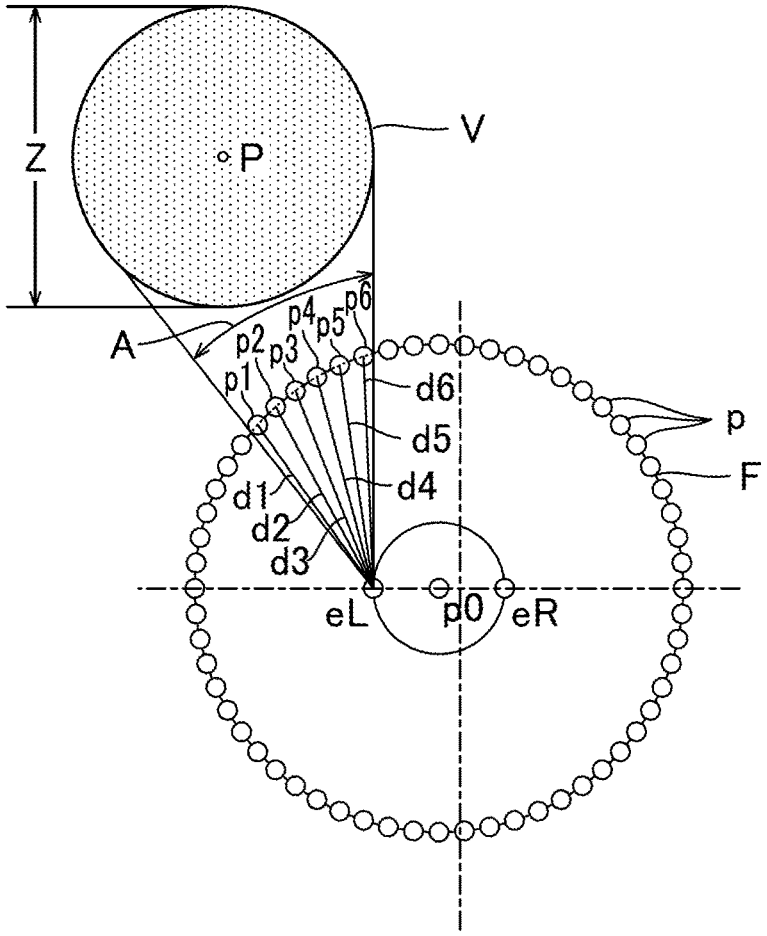
FIG. 8 is an explanatory diagram illustrating an operation of a delay corrector according to the second embodiment.

The delay corrector 38 corrects a delay amount for each of N head-related transfer characteristics H within the target range A determined by the range setter 32. FIG. 8 is a diagram explaining correction by the delay corrector 38 according to the second embodiment. As shown in FIG. 8, multiple points p on a reference plane F are located at an equal distance from a listening point p0. On the other hand, the ear position e (eR or eL) of the listener is located at a distance from the listening point p0. Accordingly, the distance d between the ear position e and each point p varies for each point p existing on the reference plane F. For example, referring to respective distances d (d1 to d6) between each of six points p (p1 to p6) and the ear position eL of the left ear within the target range A shown in FIG. 8, the distance d1 between the point p1 positioned at one edge of the target range A and the ear position eL is the shortest, while the distance d6 between the point p6 positioned at the other edge of the target range A and the ear position eL is the longest.

The head-related transfer characteristic H for each point p is associated with a delay having a delay amount δ dependent on the distance d between each point p and the ear position e. Such a delay includes, for example, delay from an impulse sound in the head-related impulse response. Thus, the delay amount δ varies for each of N head-related transfer characteristics H corresponding to each point p within the target range A. Specifically, a delay amount M in a head-related transfer characteristic H for the point p1 positioned at one edge of the target range A is the smallest, and a delay amount δ6 in a head-related transfer characteristic H for the point p6 positioned at the other edge of the target range A is the greatest.

Taking into consideration the circumstances described above, the delay corrector 38 according to the second embodiment corrects the delay amount δ of each head-related transfer characteristic H depending on the distance d between each point p and the ear position e, in a case that this correction is performed for each of N head-related transfer characteristics H corresponding to respective points p within the target range A. Specifically, the delay amount δ of each head-related transfer characteristic H is corrected such that the delay amounts δ approach one another (ideally, match one another) among the N head-related transfer characteristics H within the target range A. For example, the delay corrector 38 reduces the delay amount δ6 for the head-related transfer characteristic H for the point p6, where the distance d6 to the ear position eL is long within the target range A, and increases the delay amount δ1 for the head-related transfer characteristic H for the point p1, where the distance d1 to the ear position eL is short within the target range A. The correction of the delay amount δ by the delay amount corrector is executed for each of N head-related transfer characteristics H for the right ear and for each of N head-related transfer characteristics H for the left ear.

The characteristic synthesizer 34 in FIG. 7 generates a synthesized transfer characteristic Q by synthesizing (for example, weight averaging), as in the first embodiment, the N head-related transfer characteristics H, which have been corrected by the delay corrector 38. The characteristic imparter 36 imparts the synthesized transfer characteristic Q to an audio signal X, to generate an audio signal Y in the same manner as in the first embodiment.

The same effects as those in the first embodiment are attained in the second embodiment. Further, in the second embodiment, a delay amount δ in a head-related transfer characteristic H is corrected depending on the distance d between each point p within a target range A and the ear position e (eR or eL). Accordingly, it is possible to reduce an effect of differences in delay amount δ among multiple head-related transfer characteristics H within the target range A. In other words, a difference in time at which a sound arrives from each position of a virtual sound source V is reduced. Accordingly, the listener is able to perceive a localized virtual sound source V that is natural.

Third Embodiment

Figure 9:
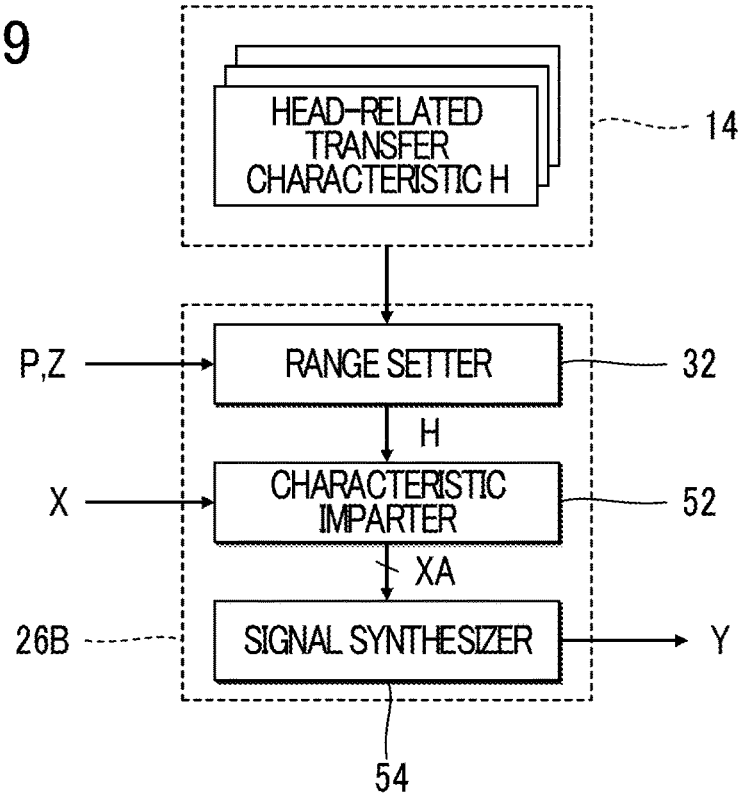
FIG. 9 is a block diagram showing a signal processor according to a third embodiment.

In the third embodiment, the signal processor 26A of the first embodiment is replaced by a signal processor 26B shown in FIG. 9. As shown in FIG. 9, the signal processor 26B of the third embodiment includes a range setter 32, a characteristic imparter 52, and a signal synthesizer 54. As in the first embodiment, the range setter 32 sets a target range A that varies depending on a position P and a size Z of a virtual sound source V for each of the right ear and the left ear, and selects N head-related transfer characteristics H within each target range A from the storage device 14 for each of the right ear and the left ear.

The characteristic imparter 52 imparts in parallel, to an audio signal X, each of the N head-related transfer characteristics H selected by the range setter 32, thereby generating an N-system audio signal XA for each of the left ear and the right ear. The signal synthesizer 54 generates an audio signal Y by synthesizing (e.g., adding) the N-system audio signal XA generated by the characteristic imparter 52. Specifically, the signal synthesizer 54 generates a right channel audio signal YR by synthesis of the N-system audio signal XA generated for the right ear by the characteristic imparter 52; and generates a left channel audio signal YL by synthesis of the N-system audio signal XA generated for the left ear by the characteristic imparter 52.

The same effects as those in the first embodiment are also attained in the third embodiment. In the third embodiment, each of the N head-related transfer characteristics H must be individually convolved into an audio signal X. On the other hand, in the first embodiment, a synthesized transfer characteristic Q generated by synthesizing (e.g., weight averaging) N head-related transfer characteristics H is convolved into an audio signal X. Thus, the configuration of the first embodiment is advantageous in view of reducing a processing burden required for convolution. It is of note that the configuration of the second embodiment also may be employed in the third embodiment.

The signal processor 26A according to the first embodiment, which synthesizes N head-related transfer characteristics H before imparting to an audio signal X, and the signal processor 26B according to the third embodiment, which synthesizes multiple audio signals XA after each head-related transfer characteristic H is imparted to an audio signal X, are generally referred to as an element (signal processor) that generates an audio signal Y by imparting a plurality of head-related transfer characteristics H to an audio signal X.

Fourth Embodiment

Figure 10:
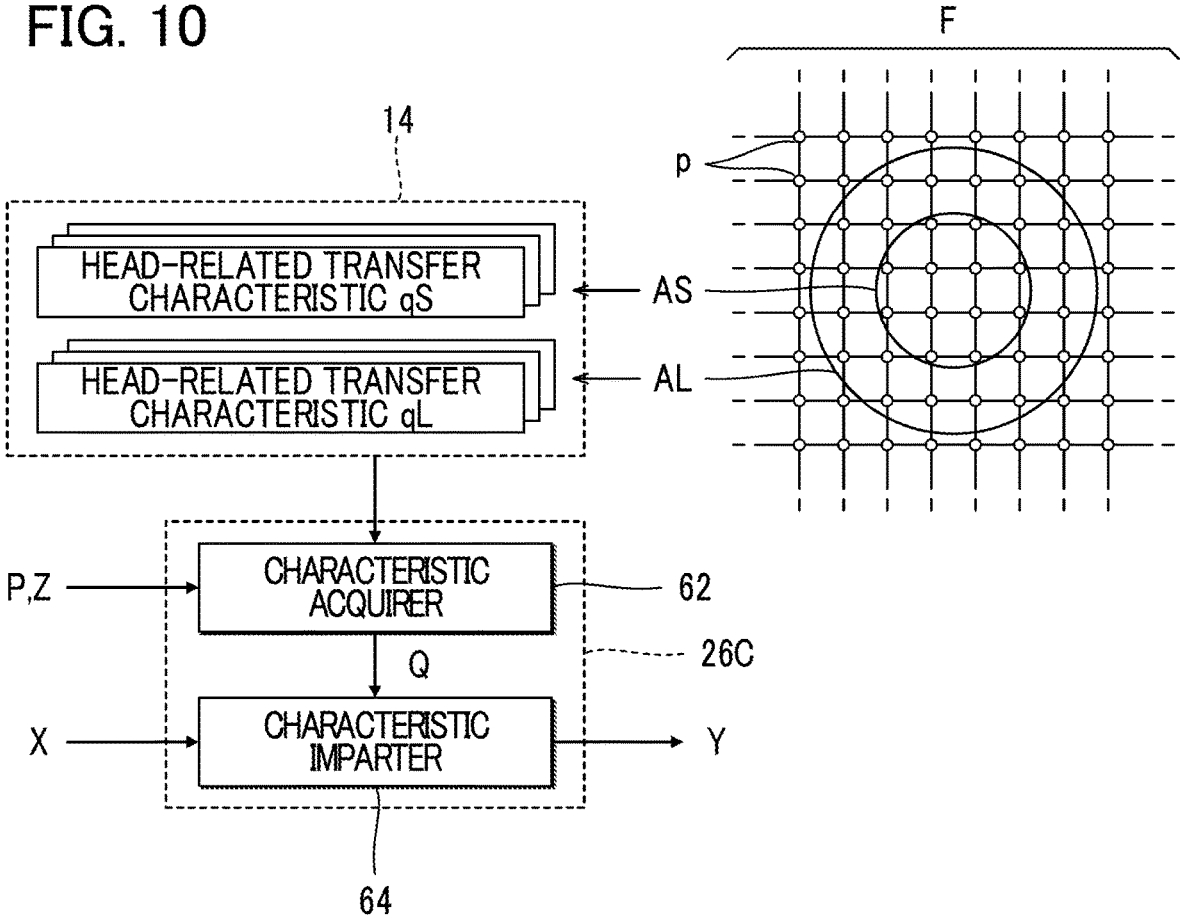
FIG. 10 is a block diagram showing a signal processor according to a fourth embodiment.

In the fourth embodiment, the signal processor 26A of the first embodiment is replaced with a signal processor 26C shown in FIG. 10. As shown in FIG. 10, the storage device 14 according to the fourth embodiment has stored therein, for each of the right ear and the left ear, and for each point p on the reference plane F, a plurality of synthesized transfer characteristics q (qL and qS) corresponding to a virtual sound source V of various sizes Z (in the following description, two types including "large (L)" and "small (S)"). A synthesized transfer characteristic q corresponding to a size Z (a size type) of a virtual sound source V is a transfer characteristic obtained by synthesizing a plurality of head-related transfer characteristics H within a target range A corresponding to the size Z. For example, similarly to the first embodiment, a plurality of head-related transfer characteristics H are weight averaged to generate a synthesized transfer characteristic q. Alternatively, as set out in the second embodiment, a synthesized transfer characteristic q may be generated by synthesizing head-related transfer characteristics H after correcting the delay amount of each head-related transfer characteristic H.

As shown in FIG. 10, a synthesized transfer characteristic qS corresponding to an arbitrary point p is a transfer characteristic obtained by synthesizing NS head-related transfer characteristics H within a target range AS that includes the point p and corresponds to a virtual sound source V of the "small" size Z. On the other hand, a synthesized transfer characteristic qL is a transfer characteristic obtained by synthesizing NL head-related transfer characteristics H within a target range AL that corresponds to a virtual sound source V of the "large" size Z. The area of the target range AL is larger than that of the target range AS. Accordingly, the number NL of head-related transfer characteristics H reflected in the synthesized transfer characteristic qL outnumbers the number NS of head-related transfer characteristics H reflected in the synthesized transfer characteristic qS (NL>NS). As described in the foregoing, a plurality of synthesized transfer characteristics q (qL and qS) corresponding to virtual sound sources V of various sizes Z are prepared for each of the right ear and the left ear and for each point p existing on the reference plane F, and are stored in the storage device 14.

Figure 11:
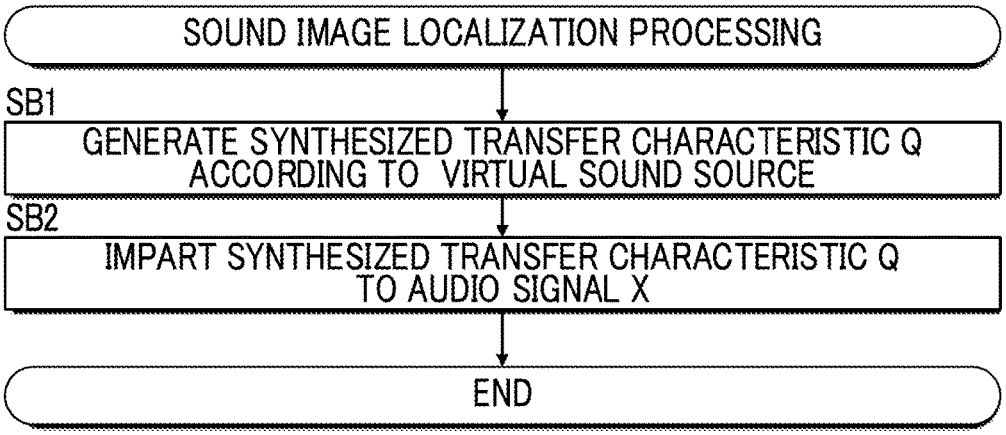
FIG. 11 is a flowchart illustrating a sound image localization processing according to the fourth embodiment.

The signal processor 26C according to the fourth embodiment is an element that generates an audio signal Y from an audio signal X through the sound image localization processing shown in FIG. 11. As shown in FIG. 10, the signal processor 26C includes a characteristic acquirer 62 and a characteristic imparter 64. The sound image localization processing according to the fourth embodiment is a signal processing that enables a listener to perceive a virtual sound source V having conditions (a position P and a size Z) set by the setting processor 24, as in the first embodiment.

The characteristic acquirer 62 generates a synthesized transfer characteristic Q corresponding to a position P and a size Z of a virtual sound source V set by the setting processor 24 from a plurality of synthesized transfer characteristics q stored in the storage device 14 (SB1). A right-ear synthesized transfer characteristic Q is generated from a plurality of synthesized transfer characteristics q for the right ear stored in the storage device 14; a left-ear synthesized transfer characteristic Q is generated from a plurality of synthesized transfer characteristics q for the left right ear stored in the storage device 14. The characteristic imparter 64 generates an audio signal Y by imparting the synthesized transfer characteristic Q generated by the characteristic acquirer 62 to an audio signal X (SB2). Specifically, the characteristic imparter 64 generates a right-channel audio signal YR by convolving the right-ear synthesized transfer characteristic Q into the audio signal X, and generates a left-channel audio signal YL by convolving the left-ear synthesized transfer characteristic Q into the audio signal X. The processing of imparting a synthesized transfer characteristic Q to an audio signal X is substantially the same as that set out in the first embodiment.

Specific examples of the processing of acquiring a synthesized transfer characteristic Q by the characteristic acquirer 62 according to the fourth embodiment (SB1) will now be described in detail. The characteristic acquirer 62 generates a synthesized transfer characteristic Q corresponding to the size Z of the virtual sound source V by interpolation using a synthesized transfer characteristic qS and a synthesized transfer characteristic qL of a point p that corresponds to the position P of the virtual sound source V set by the setting processor 24. For example, a synthesized transfer characteristic Q is generated by calculating the following formula (1) (interpolation) that employs a constant $\alpha$ depending on the size Z of the virtual sound source V. The constant $\alpha$ is a non-negative number that varies depending on the size Z and is smaller than 1 ($0 \leq \alpha \leq 1$).

$$Q=(1-\alpha)\cdot qS+\alpha\cdot qL \tag{1}$$

As will be understood from the formula (1), the greater the size Z (constant $\alpha$) of the virtual sound source V is, the more predominantly the generated synthesized transfer characteristic Q reflects the synthesized transfer characteristic qL; and, the smaller the size Z of the virtual sound source V is, the more predominantly the generated synthesized transfer characteristic Q reflects the synthesized transfer characteristic qS. In a case where the size Z of the virtual sound source V is the minimum ($\alpha=0$), the synthesized transfer characteristic qS is selected as the synthesized transfer characteristic Q, and in a case where the size Z of the virtual sound source V is the maximum ($\alpha=1$), the synthesized transfer characteristic qL is selected as the synthesized transfer characteristic Q.

As described above, in the fourth embodiment, a synthesized transfer characteristic Q reflecting a plurality of head-related transfer characteristics H corresponding to different points p is imparted to an audio signal X. Therefore, similarly to the first embodiment, it is possible to enable a person who listens to the playback sound of an audio signal Y to perceive a localized virtual sound source V as it spreads spatially. Further, since a synthesized transfer characteristic Q depending on the size Z of a virtual sound source V set by the setting processor 24 is acquired from a plurality of synthesized transfer characteristics q, a listener is able to perceive a virtual sound source V of various sizes Z similarly to the case in the first embodiment.

Moreover, in the fourth embodiment, a plurality of synthesized transfer characteristics q generated by synthesizing a plurality of head-related transfer characteristics H for each of multiple sizes of a virtual sound source V are used to acquire a synthesized transfer characteristic Q that corresponds to the size Z set by the setting processor 24. In this way, it is not necessary to carry out synthesis of a plurality of head-related transfer characteristics H (such as weighed averaging) in the acquiring step of the synthesized transfer characteristic Q. Thus, compared with a configuration in which N head-related transfer characteristics H are synthesized for each instance of using a synthesized transfer characteristic Q (as is the case in the first embodiment), the present embodiment provides an advantage in that the processing burden in acquiring a synthesized transfer characteristic Q can be reduced.

In the fourth embodiment, two types of synthesized transfer characteristics q (qL or qS) corresponding to virtual sound sources V of various sizes Z are shown as examples. Alternatively, three or more types of synthesized transfer characteristics q may be prepared for a single point p. An alternative configuration may also be employed in which a synthesized transfer characteristic q is prepared for each point p for every possible value in the size Z of a virtual sound source V. In such a configuration in which synthesized transfer characteristics q for every possible size Z of the virtual sound source V are prepared in advance, from among the thus prepared plurality of synthesized transfer characteristics q of a point p corresponding to the position P of the virtual sound source V, a synthesized transfer characteristic q that corresponds to the size Z of the virtual sound source V set by the setting processor 24 is selected as a synthesized transfer characteristic Q and imparted to an audio signal X. Accordingly, interpolation among a plurality of synthesized transfer characteristics q is omitted.

In the fourth embodiment, synthesized transfer characteristics q are prepared for each of multiple points p existing on the reference plane F. However, it is not necessary for synthesized transfer characteristics q to be prepared for every point p. For example, synthesized transfer characteristics q may be prepared for each point p selected at predetermined intervals from among multiple points p on the reference plane F. It is particularly advantageous to prepare synthesized transfer characteristics q for a greater number of points p, where the size Z of a virtual sound source to which the synthesized transfer characteristic q corresponds is smaller (for example, to prepare synthesized transfer characteristics qS for more points p than the number of points p for which synthesized transfer characteristics qL are prepared).

Modifications

Various modifications may be made to the embodiments described above. Specific modifications will be described below. Two or more modifications may be freely selected from the following and combined as appropriate so long as they do not contradict one another.

(1) In each of the above embodiments, a plurality of head-related transfer characteristics H is synthesized by weight averaging. However, a method for synthesizing a plurality of head-related transfer characteristics H is not limited thereto. For example, in the first and second embodiments, N head-related transfer characteristics H may be simply averaged to generate a synthesized transfer characteristic Q. Likewise, in the fourth embodiment, a plurality of head-related transfer characteristics H may be simply averaged to generate a synthesized transfer characteristic q.

(2) In the first to third embodiments, a target range A is individually set for the right ear and the left ear. Alternatively, a target range A may be set in common for the right ear and the left ear. For example, the range setter 32 may set a range that perspectively projects a virtual sound source V onto a reference plane F with a listening point p0 as a projection center to be a target range A for both the right and left ears. A right-ear synthesized transfer characteristic Q is generated by synthesizing right-ear head-related transfer characteristics H corresponding to N points p within the target range A. A left-ear synthesized transfer characteristic Q is generated by synthesizing left-ear head-related transfer characteristics H corresponding to N points p within the same target range A.

(3) In each embodiment described above, a target range A is described as a range corresponding to a perspective projection of a virtual sound source V onto a reference plane F, but the method of defining the target range A is not limited thereto. For example, the target range A may be set to be a range that corresponds to a parallel projection of a virtual sound source V onto a reference plane F along a straight line connecting a position P of the virtual sound source V and a listening point p0. However, in the case of the parallel projection of the virtual sound source V onto the reference plane F, the area of the target range A remains unchanged even when the distance between the listening point p0 and the virtual sound source V changes. Thus, with a view to enabling a listener to perceive changes in localization that vary depending on the position P of the virtual sound source V, it is particularly advantageous to set a range of the virtual sound source V perspectively projected on the reference plane F to be the target range A.

(4) In the second embodiment, the delay corrector 38 corrects a delay amount δ for each head-related transfer characteristic H. Alternatively, a delay amount depending on the distance between a listening point p0 and a virtual sound source V (position P) may be imparted in common to the N head-related transfer characteristics H within the target range A. For example, it may be configured such that, the greater the distance between the listening point p0 and the virtual sound source V, the greater the delay amount of each head-related transfer characteristic H.

(5) In each embodiment described above, the head-related impulse response, which is in the time domain, is used to express the head-related transfer characteristic H. Alternatively, an HRTF (head-related transfer function), which is in the frequency domain, may be used to express the head-related transfer characteristic H. With a configuration using head-related transfer functions, a head-related transfer characteristic H is imparted to an audio signal X in the frequency domain. As will be understood from the foregoing explanation, the head-related transfer characteristic H is a concept encompassing both time-domain head-related impulse responses and frequency-domain head-related transfer functions.

(6) An audio processing apparatus 100 may be realized by a server apparatus that communicates with a terminal apparatus (e.g., a portable phone or a smartphone) via a communication network, such as a mobile communication network or the Internet. For example, the audio processing apparatus 100 receives from the terminal apparatus operation information indicative of user's operations to the terminal apparatus via the communication network. The setting processor 24 sets a position P and a size Z of a virtual sound source depending on the operation information received from the terminal apparatus. In the same manner as in each of the above described embodiments, the signal processor 26

(26A, 26B, or 26C) generates an audio signal Y through the sound image localization processing on an audio signal X such that a virtual sound source of the size Z that produces the audio of the audio signal X is localized at the position P in relation to the listener. The audio processing apparatus 100 transmits the audio signal Y to the terminal apparatus. The terminal apparatus plays the audio represented by the audio signal Y.

(7) As described above, the audio processing apparatus 100 shown in each of the above embodiments is realized by the control device 12 and a program working in coordination with each other. For example, a program according to a first aspect (e.g., from the first to third embodiments) causes a computer, such as the control device 12 (e.g., one or a plurality of processing circuits), to function as a setting processor 24 that sets a size Z of a virtual sound source V to be variable, and a signal processor (26A or 26B) that generates an audio signal Y by imparting to an audio signal X a plurality of head-related transfer characteristics H corresponding to respective points p within a target range A that varies depending on the size Z set by the setting processor 24, from among a plurality of points p each of which has a different position relative to a listening point p0.

A program corresponding to a second aspect (e.g., the fourth embodiment) causes a computer, such as the control device 12 (e.g., one or a plurality of processing circuits), to function as a setting processor 24 that sets a size Z of a virtual sound source V to be variable; a characteristic acquirer 62 that acquires a synthesized transfer characteristic Q corresponding to the size Z set by the setting processor 24 from a plurality of synthesized transfer characteristics q generated by synthesizing, for each of multiple sizes Z of the virtual sound source V, a plurality of head-related transfer characteristics H corresponding to respective points p within a target range A that varies depending on each size Z, from among a plurality of points p each of which has a different position relative to a listening point p0; and a characteristic imparter 64 that generates an audio signal Y by imparting to an audio signal X a synthesized transfer characteristic Q acquired by the characteristic acquirer 62.

Each of the programs described above may be provided in a form stored in a computer-readable recording medium, and be installed on a computer. For instance, the storage medium may be a non-transitory storage medium, a preferable example of which is an optical storage medium, such as a CD-ROM (optical disc), and may also be a freely-selected form of well-known storage media, such as a semiconductor storage medium and a magnetic storage medium. The "non-transitory storage medium" is inclusive of any computer-readable recording media with the exception of a transitory, propagating signal, and does not exclude volatile recording media. Each program may be distributed to a computer via a communication network.

(8) A preferable aspect of the present invention may be an operation method (audio processing method) of the audio processing apparatus 100 illustrated in each of the above described embodiments. In an audio processing method according to the first aspect (e.g., from the first to third embodiments), a computer (a single computer or a system configured by multiple computers) sets a size Z of a virtual sound source V to be variable, and generates an audio signal Y by imparting to an audio signal X a plurality of head-related transfer characteristics H corresponding to respective points p within a target range A that accords with the set size Z, from among a plurality of points p, with each point having a different position relative to a listening point p0. In an audio processing method according to the second aspect (e.g., the fourth embodiment), a computer (a single computer or a system configured by multiple computers) sets a size Z of a virtual sound source V to be variable; acquires a synthesized transfer characteristic Q according to the set size Z from among a plurality of synthesized transfer characteristics q, each synthesized transfer characteristic q being generated for each of a plurality of sizes Z of the virtual sound source V by synthesizing a plurality of head-related transfer characteristics H corresponding to respective points p within a target range A that accords with each size Z, from among a plurality of points p, with each point having a different position relative to a listening point p0; and generates an audio signal Y by imparting the synthesized transfer characteristic Q to an audio signal X.

(9) Following are examples of configurations derived from the above embodiments.

First Mode

An audio processing method according to a preferred mode (First Mode) of the present invention sets a size of a virtual sound source; and generates a second audio signal by imparting to a first audio signal a plurality of head-related transfer characteristics. The plurality of head-related transfer characteristics corresponds to respective points within a range that accords with the set size from among a plurality of points, with each point having a different position relative to a listening point. In this mode, a plurality of head-related transfer characteristics corresponding to various points are imparted to a first audio signal, and as a result a listener of a playback sound of a second audio signal is able to perceive a localized virtual sound source as it spreads spatially. If the range is set so that it varies depending on the size of a virtual sound source, a virtual sound source of different sizes can be perceived by a listener.

Second Mode

In a preferred example (Second Mode) of First Mode, the generation of the second audio signal includes: setting the range in accordance with the size of the virtual sound source; and synthesizing the plurality of head-related transfer characteristics corresponding to the respective points within the set range to generate a synthesized head-related transfer characteristic; and generating the second audio signal by imparting the synthesized head-related transfer characteristic to the first audio signal. In this mode, a head-related transfer characteristic that is generated by synthesizing a plurality of head-related transfer characteristics within a range is imparted to a first audio signal. Therefore, compared with a configuration in which each of a plurality of head-related transfer characteristics within the range is imparted to the first audio signal before synthesizing them, a processing burden (e.g., convolution) required for imparting the head-related transfer characteristics can be reduced.

Third Mode

In a preferred example (Third Mode) of Second Mode, the method further sets a position of the virtual sound source, the setting of the range including setting the range according to the size and the position of the virtual sound source. In this mode, since the size and the position of a virtual sound source are set, the position of a spatially spreading virtual sound source can be changed.

Fourth Mode

In a preferred example (Fourth Mode) of Second Mode or Third Mode, the synthesizing of the plurality of head-related transfer characteristics includes weight averaging the plurality of head-related transfer characteristics by using weighted values, each of the weighted values being set in accordance with a position of each point within the range. In this mode, weighted values that are set depending on the positions of respective points within a range are used for weight averaging a plurality of head-related transfer characteristics. Accordingly, diverse characteristics can be imparted to the first audio signal, where the diverse characteristics reflect each of multiple head-related transfer characteristics H to an extent depending on the position of a corresponding point within the range.

Fifth Mode

In a preferred example (Fifth Mode) of any one of Second Mode to Fourth Mode, the setting of the range includes setting the range by perspectively projecting the virtual sound source onto a reference plane including the plurality of points, with the center of the projection being the listening point or an ear position corresponding to the listening point. In this mode, a range is set by perspectively projecting a virtual sound source onto a reference plane with a listening point or an ear position being the projection center, and therefore, the area of a target range changes depending on the distance between the listening point and the virtual sound source, and the number of head-related transfer characteristics in the target range changes accordingly. In this way, a listener is able to perceive changes in distance between the listening point and the virtual sound source.

Sixth Mode

In a preferred example (Sixth Mode) of any one of First Mode to Fifth Mode, the method sets the range individually for each of a right ear and a left ear; and generates the second audio signal for a right channel by imparting to the first audio signal the plurality of head-related transfer characteristics for the right ear, the plurality of head-related transfer characteristics corresponding to respective points within the range set with regard to the right ear, and generates the second audio signal for a left channel by imparting to the first audio signal the plurality of head-related transfer characteristics for the left ear, the plurality of head-related transfer characteristics corresponding to respective points within the range set with regard to the left ear. In this mode, since a range is individually set for the right ear and the left ear, it is possible to generate a second audio signal, for which a localized virtual sound source can be clearly perceived by a listener.

Seventh Mode

In a preferred example (Seventh Mode) of any one of the First Mode to Fifth Mode, the method sets the range, which is common for a right ear and a left ear; and generates the second audio signal for a right channel by imparting to the first audio signal the plurality of head-related transfer characteristics for the right ear, the plurality of head-related transfer characteristics corresponding to respective points within the range, and generates the second audio signal for a left channel by imparting to the first audio signal the plurality of head-related transfer characteristics for the left ear, the plurality of head-related transfer characteristics corresponding to respective points within the range. In this mode, the same range is set for the right ear and the left ear. Accordingly, this mode has an advantage in that an amount of computation is reduced compared to a configuration in which the range is set individually for the right ear and the left ear.

Eighth Mode

In a preferred example (Eighth Mode) of any one of the Second Mode to Seventh Mode, the generation of the second audio signal includes correcting, for each of the plurality of head-related transfer characteristics corresponding to the respective points within the range, a delay amount of each head-related transfer characteristic according to a distance between each point and an ear location at the listening point; and the synthesizing of the plurality of head-related transfer characteristics includes synthesizing the corrected head-related transfer characteristics. In this mode, a delay amount of each head-related transfer characteristic is corrected depending on the distance between each point within a range and an ear position. As a result, it is possible to reduce the effect of differences in delay amounts in a plurality of head-related transfer characteristics within the range. Accordingly, a listener is able to perceive a localized virtual sound source that is natural.

Ninth Mode

An audio processing method according to a preferred mode (Ninth Mode) of the present invention sets a size of a virtual sound source; and acquires a synthesized transfer characteristic in accordance with the set size from a plurality of synthesized transfer characteristics, each synthesized transfer characteristic being generated for each of a plurality of sizes of the virtual sound source by synthesizing a plurality of head-related transfer characteristics corresponding to respective points within a range that accords with each size from among a plurality of points, with each point having a different position relative to a listening point; and generates a second audio signal by imparting to a first audio signal the acquired synthesized transfer characteristic. In this mode, a synthesized transfer characteristic reflecting a plurality of head-related transfer characteristics corresponding to various points is imparted to a first audio signal. Accordingly, a person who listens to a playback sound of a second audio signal is able to perceive a localized virtual sound source as it spreads spatially. Also, a synthesized transfer characteristic reflecting a plurality of head-related transfer characteristics within a range depending on the size of a virtual sound source is imparted to a first audio signal. Accordingly, a listener is able to perceive a virtual sound source of various sizes. Moreover, from among a plurality of synthesized transfer characteristics corresponding to the virtual sound source of various sizes, a synthesized transfer characteristic that corresponds to the set size is imparted to a first audio signal. Accordingly, it is not necessary to carry out synthesis of a plurality of head-related transfer characteristics in the acquiring step of the synthesized transfer characteristic. Accordingly, this mode has an advantage in that a processing burden required for acquiring a synthesized transfer characteristic can be reduced, compared to a configuration in which a plurality of head-related transfer characteristics are synthesized each time a synthesized transfer characteristic is used.

Tenth Mode

An audio processing apparatus according to a preferred mode (Tenth Mode) of the present invention includes a setting processor that sets a size of a virtual sound source; and a signal processor that generates a second audio signal by imparting to a first audio signal a plurality of head-related transfer characteristics. The plurality of head-related transfer characteristics corresponds to respective points within a range that accords with the size set by the setting processor from among a plurality of points, with each point having a different position relative to a listening point. In this mode, a plurality of head-related transfer characteristics corresponding to various points are imparted to a first audio signal, and therefore, a listener of a playback sound of a second audio signal is able to perceive a localized virtual sound source as it spreads spatially. If the range is set so that it varies depending on the size of a virtual sound source, a virtual sound source of different sizes can be perceived by a listener.

Eleventh Mode

An audio processing apparatus according to a preferred mode (Eleventh Mode) of the present invention includes a setting processor that sets a size of a virtual sound source; a characteristic acquirer that acquires a synthesized transfer characteristic in accordance with the size set by the setting processor from a plurality of synthesized transfer characteristics, each synthesized transfer characteristic being generated for each of a plurality of sizes of the virtual sound source by synthesizing a plurality of head-related transfer characteristics corresponding to respective points within a range that accords with each size from among a plurality of points, with each point having a different position relative to a listening point; and a characteristic imparter that generates a second audio signal by imparting to a first audio signal the acquired synthesized transfer characteristic. In this mode, a synthesized transfer characteristic reflecting a plurality of head-related transfer characteristics corresponding to various points is imparted to a first audio signal. Accordingly, a person who listens to a playback sound of a second audio signal is able to perceive a localized virtual sound source as it spreads spatially. Also, a synthesized transfer characteristic reflecting a plurality of head-related transfer characteristics within a range depending on the size of a virtual sound source is imparted to a first audio signal. Accordingly, a listener is able to perceive a virtual sound source of various sizes. Moreover, from among a plurality of synthesized transfer characteristics corresponding to the virtual sound source of various sizes, a synthesized transfer characteristic that corresponds to the set size is imparted to a first audio signal, and therefore, it is not necessary to carry out a synthesis operation of a plurality of head-related transfer characteristics in the acquiring step of the synthesized transfer characteristic. Accordingly, this mode has an advantage in that a processing burden required for acquiring a synthesized transfer characteristic can be reduced, compared to a configuration in which a plurality of head-related transfer characteristics are synthesized each time a synthesized transfer characteristic is used.

DESCRIPTION OF REFERENCE SIGNS

100 . . . audio processing apparatus, 12 . . . control device, 14 . . . storage device, 16 . . . sound outputter, 22 . . . audio generator, 24 . . . setting processor, 26A,26B,26C . . . signal processor, 32 . . . range setter, 34 . . . characteristic synthesizer, 36,52,64 . . . characteristic imparter, 38 . . . delay corrector, 54 . . . signal synthesizer, 62 . . . characteristic acquirer.

What is claimed is:

1. An audio processing method comprising:

providing a first audio signal;

setting a size of a virtual sound source that is larger than a point to enable a listener to perceive a spatial spread of a sound image of sound produced from the first audio signal;

setting a range according to the set size, from among a plurality of points each in a different position relative to a listening point, individually for each of a right ear and a left ear;

generating a second audio signal by imparting, to the first audio signal, a plurality of head-related transfer characteristics corresponding to multiple points within the set range for:

a right channel by imparting to the first audio signal a plurality of right head-related transfer characteristics for the right ear corresponding to respective points within the range set with regard to the right ear; and a left channel by imparting to the first audio signal a plurality of left head-related transfer characteristics for the left ear corresponding to respective points within the range set with regard to the left ear.

2. The audio processing method according to claim 1, wherein:

the setting of the range further sets the range individually for each of the right ear and the left ear according to the size of the virtual sound source, the generating of the second audio signal includes:

synthesizing the plurality of head-related transfer characteristics corresponding to the respective points within the set range to generate a synthesized head-related transfer characteristic individually each for the right ear and the left ear; and imparting the synthesized head-related transfer characteristics to the first audio signal individually each for the right ear and the left ear to generate the second audio signal.

3. The audio processing method according to claim 2, further comprising:

setting a position of the virtual sound source, wherein the setting of the range includes setting the range further according to the size and the position of the virtual sound source individually for each of the right ear and the left ear.

4. The audio processing method according to claim 2, wherein the synthesizing of the plurality of head-related transfer characteristics includes weight averaging the plurality of head-related transfer characteristics using weighted values each set in accordance with a position of each point within the set range individually for each of the right ear and the left ear.

5. The audio processing method according to claim 2, wherein the setting of the range includes setting the range by perspectively projecting the virtual sound source onto a reference plane including the plurality of points, with the center of the projection being the listening point or an ear position corresponding to the listening point individually for each of the right ear and the left ear.

6. The audio processing method according to claim 2, wherein:

the generating of the second audio signal includes correcting, for each of the plurality of head-related transfer characteristics corresponding to the respective points within the set range, a delay amount of each head-related transfer characteristic according to a distance between each point and an ear location at the listening point individually for each of the right ear and the left ear, and the synthesizing of the plurality of head-related transfer characteristics includes synthesizing the corrected head-related transfer characteristics to the first audio signal individually for each of right ear and the left ear to generate the second audio signal.

7. An audio processing apparatus comprising:

at least one processor configured to execute stored instructions to:

obtain a first audio signal;

set a size of a virtual sound source that is larger than a point to enable a listener to perceive a spatial spread of a sound image of sound produced from the first audio signal; and set a range according to the set size, from among a plurality of points each in a different position relative to a listening point, individually for each of a right ear and a left ear;

generate a second audio signal by imparting, to the first audio signal, a plurality of head-related transfer characteristics corresponding to multiple points within the set range for:

a right channel by imparting to the first audio signal a plurality of head-related transfer characteristics for the right ear corresponding to respective points within the range set with regard to the right ear; and a left channel by imparting to the first audio signal a plurality of head-related transfer characteristics for the left ear corresponding to respective points within the range set with regard to the left ear.

8. The audio processing apparatus according to claim 7, wherein:

the at least one processor setting the range, further sets the range individually for each of the right ear and the left ear according to the size of the virtual sound source;

the at least one processor, in generating the second audio signal:

synthesizes the plurality of head-related transfer characteristics corresponding to the respective points within the set range to generate a synthesized head-related transfer characteristic individually each for the right ear and the left ear; and imparts the synthesized head-related transfer characteristics to the first audio signal individually each for the right ear and the left ear to generate the second audio signal.

9. The audio processing apparatus according to claim 8, wherein:

the at least one processor is further configured to set a position of the virtual sound source, and the at least one processor, in setting the range, sets the range further according to the size and the position of the virtual sound source individually for each of the right ear and the left ear.

10. The audio processing apparatus according to claim 8, wherein the at least one processor, in synthesizing the plurality of head-related transfer characteristics, weight average the plurality of head-related transfer characteristics using weighted values each set in accordance with a position of each point within the set range individually for each of the right ear and the left ear.

11. The audio processing apparatus according to claim 8, wherein the at least one processor, in setting the range, sets the range by perspectively projecting the virtual sound source onto a reference plane including the plurality of points, with the center of the projection being the listening point or an ear position corresponding to the listening point individually for each of the right ear and the left ear.

12. The audio processing apparatus according to claim 8, wherein the at least one processor:

in generating the second audio signal, corrects, for each of the plurality of head-related transfer characteristics corresponding to the respective points within the set range, a delay amount of each head-related transfer characteristic according to a distance between each point and an ear location at the listening point individually for each of the right ear and the left ear; and in synthesizing the plurality of head-related transfer characteristics, synthesizes the corrected head-related transfer characteristics to the first audio signal individually for each of the right ear and the left ear to generate the second audio signal.

* * * * *